US010065775B2

(12) United States Patent
Estes et al.

(10) Patent No.: US 10,065,775 B2
(45) Date of Patent: Sep. 4, 2018

(54) DISPENSING CAP FOR A CONTAINER

(71) Applicant: Granite State Product Development LLC, Dover, DE (US)

(72) Inventors: Allen Estes, Standish, ME (US); John Porter, Northwood, NH (US)

(73) Assignee: GRANITE STATE PRODUCT DEVELOPMENT LLC, Dover, DE (US)

( * ) Notice: Subject to any disclaimer, the term of this patent is extended or adjusted under 35 U.S.C. 154(b) by 553 days.

(21) Appl. No.: 14/932,073

(22) Filed: Nov. 4, 2015

(65) Prior Publication Data

US 2016/0052685 A1 Feb. 25, 2016

Related U.S. Application Data

(63) Continuation-in-part of application No. 14/513,849, filed on Oct. 14, 2014, now abandoned, which is a continuation of application No. 14/061,029, filed on Oct. 23, 2013, now abandoned, which is a continuation of application No. 13/363,953, filed on Feb. 1, 2012, now Pat. No. 8,613,372.

(60) Provisional application No. 61/438,440, filed on Feb. 1, 2011.

(51) Int. Cl.
*B65D 51/00* (2006.01)
*B65D 51/28* (2006.01)
*B65D 41/34* (2006.01)

(52) U.S. Cl.
CPC ..... *B65D 51/2864* (2013.01); *B65D 41/3428* (2013.01)

(58) Field of Classification Search
CPC ..... B65D 51/2864; B65D 41/3428; B65D 51/2821; B65D 51/2828; B65D 25/08
USPC ..... 220/521
See application file for complete search history.

(56) References Cited

U.S. PATENT DOCUMENTS

| | | | |
|---|---|---|---|
| 2,524,607 | A | 10/1950 | Smith |
| 2,764,157 | A | 9/1956 | Oliva et al. |
| 2,793,776 | A | 5/1957 | Lipari |
| 3,326,400 | A | 6/1967 | Hamelin et al. |
| 3,539,794 | A | 11/1970 | Rauhut et al. |
| 3,779,372 | A | 12/1973 | de Lloret |
| 4,102,451 | A | 7/1978 | Clarke et al. |
| 4,103,772 | A | 8/1978 | Wiegner |

(Continued)

FOREIGN PATENT DOCUMENTS

| | | |
|---|---|---|
| CN | 101233052 | 7/2008 |
| CN | 101374735 | 2/2009 |

(Continued)

OTHER PUBLICATIONS

Extended European Search Report dated Dec. 8, 2017 for corresponding European Patent Application No. 12742406.7.

(Continued)

*Primary Examiner* — Ernesto Grano
(74) *Attorney, Agent, or Firm* — Duane Morris LLP

(57) ABSTRACT

A dispensing cap for a container includes a body portion and an integrally formed chamber for holding an additive substance. An inner wall integrally formed with the body portion defines the chamber whose open end is sealed by a chamber closure member. The chamber closure member being configured for cooperating with the inner wall and seal the chamber, wherein the body portion, the closed top end, the plunger, and the inner wall are integrally formed.

16 Claims, 12 Drawing Sheets

(56) References Cited

U.S. PATENT DOCUMENTS

| | | | |
|---|---|---|---|
| 4,221,291 | A | 9/1980 | Hunt |
| 4,315,570 | A | 2/1982 | Silver et al. |
| 4,572,376 | A | 2/1986 | Wrennall |
| 4,770,305 | A | 9/1988 | Su |
| 4,785,931 | A | 11/1988 | Weir et al. |
| 4,903,865 | A | 2/1990 | Janowitz |
| 4,971,193 | A | 11/1990 | Groves et al. |
| 4,979,645 | A | 12/1990 | Groves et al. |
| 5,035,320 | A | 7/1991 | Plone |
| 5,431,276 | A | 7/1995 | Lialin |
| 5,531,363 | A | 7/1996 | Gross et al. |
| 5,542,528 | A | 8/1996 | Lafranconi et al. |
| 5,547,275 | A | 8/1996 | Lillelund et al. |
| 5,638,968 | A | 6/1997 | Baron et al. |
| 5,762,199 | A | 6/1998 | Aguilera |
| 5,772,017 | A | 6/1998 | Kang |
| 5,785,044 | A | 7/1998 | Meador et al. |
| 5,839,573 | A | 11/1998 | Morini |
| 5,863,126 | A | 1/1999 | Guild |
| 5,927,549 | A | 7/1999 | Wood |
| 5,992,693 | A | 11/1999 | Albisetti |
| 6,003,728 | A | 12/1999 | Elliott |
| 6,257,428 | B1 | 7/2001 | Caola |
| 6,435,341 | B1 | 8/2002 | Nobbio |
| 6,513,650 | B2 | 2/2003 | Mollstam et al. |
| 6,840,373 | B2 | 1/2005 | Gibler et al. |
| 6,854,595 | B2 | 2/2005 | Kiser |
| 6,959,839 | B2 | 11/2005 | Roth et al. |
| 6,959,841 | B2 | 11/2005 | Vlodek |
| 6,976,578 | B1 | 12/2005 | Kenihan |
| 7,503,453 | B2 | 3/2009 | Cronin et al. |
| 7,506,782 | B2 | 3/2009 | Walters |
| 7,559,432 | B2 | 7/2009 | Marvin et al. |
| 7,568,576 | B2 | 8/2009 | Sweeney et al. |
| 7,588,808 | B2 | 9/2009 | Hutchinson et al. |
| 7,681,726 | B2 | 3/2010 | O'Donnell et al. |
| 7,854,104 | B2 | 12/2010 | Cronin et al. |
| 7,874,420 | B2 | 1/2011 | Coon |
| 7,896,155 | B2 | 3/2011 | Seelhofer |
| 8,016,159 | B2 | 9/2011 | Ma |
| 8,070,014 | B2 | 12/2011 | Wisniewski |
| 8,083,055 | B2 | 12/2011 | Simonian et al. |
| 8,328,010 | B2 | 12/2012 | Lee et al. |
| 8,336,706 | B2 | 12/2012 | Lee et al. |
| 8,443,970 | B2 | 5/2013 | Coon |
| 8,453,834 | B2 | 6/2013 | Porter |
| 8,499,971 | B2 | 8/2013 | Roth et al. |
| 8,613,372 | B2 | 12/2013 | Porter |
| 8,695,819 | B1 | 4/2014 | Anderson |
| 2002/0066679 | A1 | 6/2002 | Moscovitz |
| 2004/0026422 | A1 | 2/2004 | Westphal |
| 2005/0040052 | A1 | 2/2005 | Dixon |
| 2006/0243742 | A1 | 11/2006 | Smith et al. |
| 2007/0284265 | A1 | 12/2007 | Parker |
| 2008/0067172 | A1 | 3/2008 | Wilhelm |
| 2008/0093381 | A1 | 4/2008 | Smith et al. |
| 2008/0179331 | A1 | 7/2008 | Sharp |
| 2009/0260999 | A1 | 10/2009 | Yang et al. |
| 2010/0012532 | A1 | 1/2010 | Frutin |
| 2010/0025356 | A1 | 2/2010 | Lee et al. |
| 2010/0044377 | A1 | 2/2010 | Porter |
| 2010/0140266 | A1 | 6/2010 | Lohrman et al. |
| 2010/0200437 | A1 | 8/2010 | Coon |
| 2010/0237075 | A1 | 9/2010 | Wilhelm |
| 2011/0000800 | A1 | 1/2011 | Rohr et al. |
| 2011/0024454 | A1 | 2/2011 | Dyrbye et al. |
| 2011/0068102 | A1 | 3/2011 | Porter |
| 2011/0174642 | A1 | 7/2011 | Coon |
| 2011/0192735 | A1 | 8/2011 | Cronin et al. |
| 2012/0061421 | A1 | 3/2012 | Roth et al. |
| 2012/0199503 | A1 | 8/2012 | Dyrbye et al. |
| 2012/0217178 | A1 | 8/2012 | Rohr et al. |

FOREIGN PATENT DOCUMENTS

| | | |
|---|---|---|
| JP | 03-114776 | 11/1991 |
| JP | 2000037441 | 2/2000 |
| WO | 2006/046730 | 5/2006 |
| WO | 2009100274 | 8/2009 |

OTHER PUBLICATIONS

International Search Report and Written Opinion issued in connection with PCT/US2012/023506, filing date Feb. 1, 2012, in the name of Granite State Product Development LLC.

First Office Action dated Sep. 25, 2014 for corresponding CN Application No. 201280011810.6.

DISPENSING CAP FOR A CONTAINER

CROSS-REFERENCE TO RELATED CASES

This application is a continuation-in-part of copending U.S. patent application Ser. No. 14/513,849, filed Oct. 14, 2014, which is a continuation of U.S. patent application Ser. No. 14/061,029, filed Oct. 23, 2013, which is a continuation of U.S. patent application Ser. No. 13/363,953, filed Feb. 1, 2012, now U.S. Pat. No. 8,613,372 issued on Dec. 24, 2013, which claims benefit of the priority to U.S. provisional patent application No. 61/438,440, filed on Feb. 1, 2011 under 35 U.S.C. § 119(e), the contents of which are each incorporated herein by reference in their entirety.

FIELD OF THE INVENTION

The present disclosure relates generally to a container closure lid and more particularly to an attachable container lid having a compartment for holding, storing and dispensing an additive substance.

BACKGROUND

Containers of various designs for separately holding additive substances until they are ready to be mixed with a solvent fluid are known. However, many are limited in their capacity to hold different number of component substances and impractical in configuration for efficient manufacturing. Thus, there is a need for improved lid for a container.

SUMMARY

According to an embodiment of the present disclosure, a dispensing cap for a container comprises a generally cylindrically-shaped body portion having a closed top end and an open bottom end, the closed top end being integrally formed with the body portion and comprising a diaphragm portion. A generally cylindrically-shaped inner wall axially extends from the closed top end towards the open bottom end of the body portion and defines a chamber for holding an additive substance, wherein the chamber has an opening towards the open bottom end of the body portion. The body portion and the inner wall define a receptacle therebetween for receiving a mouth of the container from the open bottom end of the body portion and sealing the mouth of the container. A plunger axially extends from the diaphragm portion towards the opening of the chamber, wherein the diaphragm and the plunger have a closed position and an open position. A chamber closure member for sealing the chamber's opening is attached to the plunger, wherein the chamber closure member is configured for cooperating with the inner wall and seal the chamber when the diaphragm and the plunger are in the closed position. The body portion, the closed top end and the inner wall are integrally formed.

A dispensing cap for a container according to another embodiment is disclosed. The dispensing cap comprises: a generally cylindrically-shaped body portion having a closed top end and an open bottom end, the closed top end comprising a diaphragm portion; a generally cylindrically-shaped inner wall axially extending from the closed top end towards the open bottom end of the body portion and defining a chamber for holding an additive substance, wherein the chamber has an opening towards the open bottom end of the body portion; the body portion and the inner wall defining a receptacle therebetween for receiving a mouth of the container from the open bottom end of the body portion and sealing the mouth of the container; a plunger axially extending from the diaphragm portion towards the opening of the chamber, wherein the diaphragm and the plunger have a closed position and an open position; and a chamber closure member for sealing the chamber's opening attached to the plunger, wherein the chamber closure member is a disc-like structure having a sealing surface along its periphery and the inner wall has a corresponding sealing surface that cooperates with the sealing surface of the chamber closure member for sealing the chamber when the diaphragm and the plunger are in the closed position, wherein the chamber closure member has a top side that faces the closed top end of the body portion and a bottom side that faces away from the chamber, and further wherein the chamber closure member is provided with one or more stress-relieving depressions on the top side, thereby when an activating force is applied to the diaphragm and the plunger is being moved from the closed position to the open position, the one or more stress-relieving depressions enable the chamber closure member to elastically collapse and facilitate unsealing of the chamber closure member from the inner wall, wherein the one or more stress-relieving depressions comprise a first annular depression extending circumferentially along a periphery of the chamber closure member, wherein the body portion, the closed top end, the plunger, and the inner wall are integrally formed.

A dispensing cap for a container according to another embodiment is also disclosed. The dispensing cap comprises: a generally cylindrically-shaped body portion having a closed top end and an open bottom end, the closed top end comprising a diaphragm portion; a generally cylindrically-shaped inner wall axially extending from the closed top end towards the open bottom end of the body portion and defining a chamber for holding an additive substance, wherein the chamber has an opening towards the open bottom end of the body portion; the body portion and the inner wall defining a receptacle therebetween for receiving a mouth of the container from the open bottom end of the body portion and sealing the mouth of the container; a plunger axially extending from the diaphragm portion towards the opening of the chamber, wherein the diaphragm and the plunger have a closed position and an open position; and a chamber closure member for sealing the chamber's opening attached to the plunger, wherein the chamber closure member is a disc-like structure having a sealing surface along its periphery and the inner wall has a corresponding sealing surface that cooperates with the sealing surface of the chamber closure member for sealing the chamber when the diaphragm and the plunger are in the closed position, wherein the chamber closure member has a top side that faces the closed top end of the body portion and a bottom side that faces away from the chamber, and further wherein the chamber closure member is provided with a stress-relieving depression on the top side, thereby when an activating force is applied to the diaphragm and the plunger is being moved from the closed position to the open position, the one or more stress-relieving depressions enable the chamber closure member to elastically collapse and facilitate unsealing of the chamber closure member from the inner wall, wherein the stress-relieving depression comprises an annular depression extending circumferentially along a periphery of the chamber closure member.

BRIEF DESCRIPTION OF THE DRAWINGS

These and other features and advantages of the present invention will be more fully disclosed in the following detailed description of a preferred embodiment of the invention, which is to be considered together with the accompanying drawings wherein like numbers refer to like parts. All drawing figures are schematic and are not intended to show true dimensions or true dimensional relationship among the structures.

DETAILED DESCRIPTION

Figure 1:
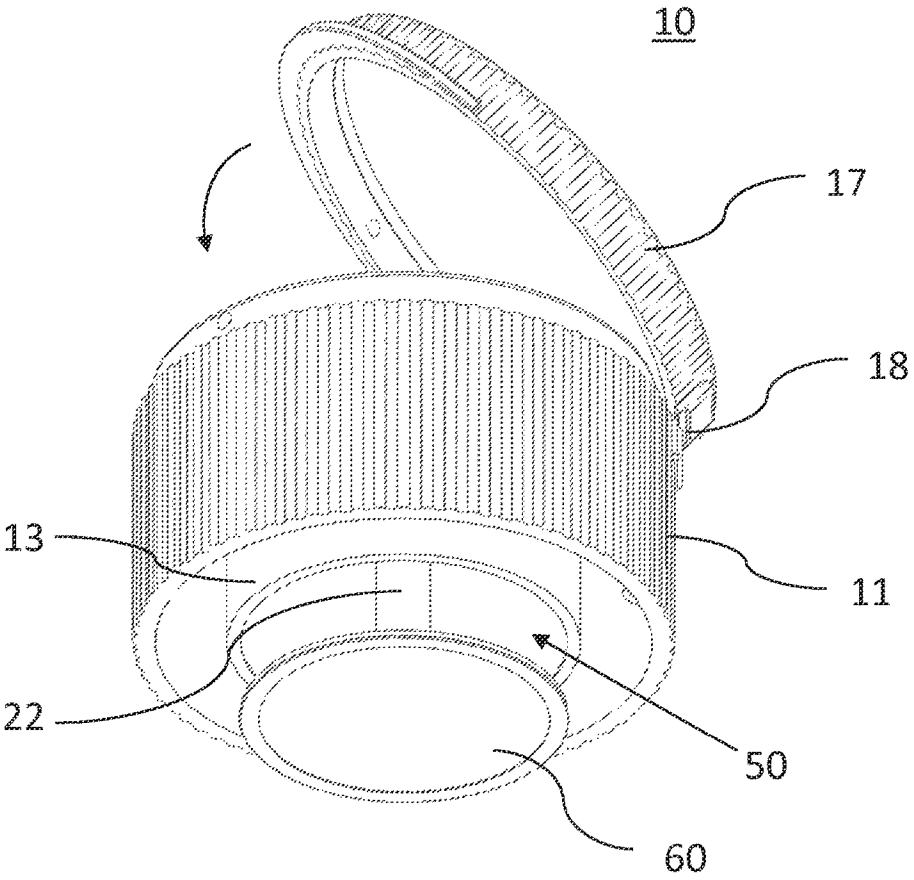
FIG. 1 is an isometric view of a dispensing cap according to an embodiment of the present disclosure.
Figure 2:
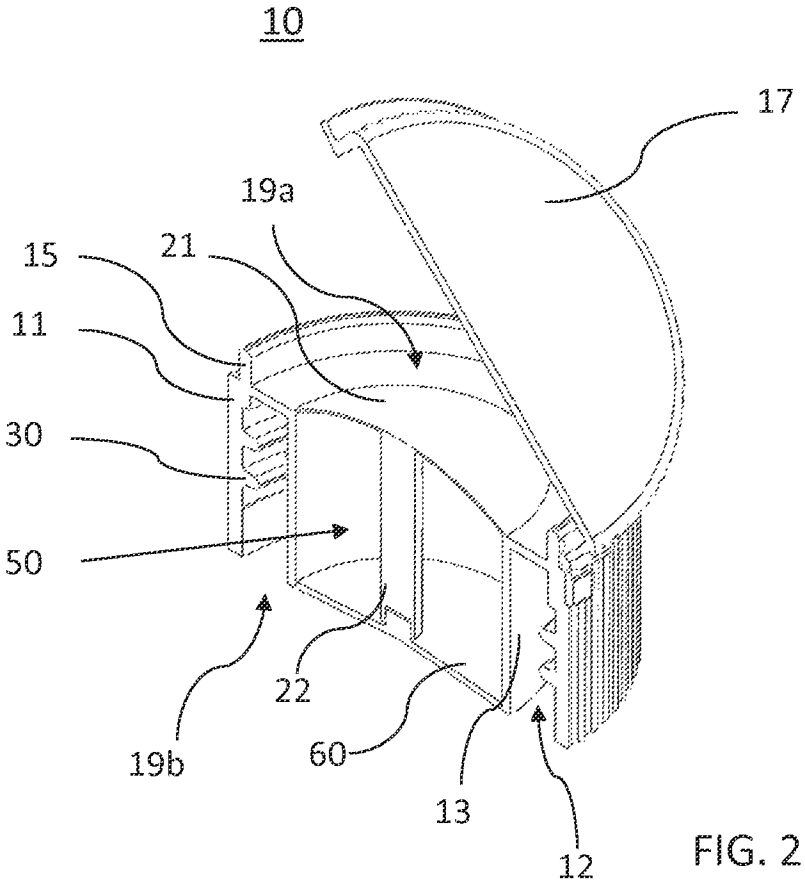
FIG. 2 is an isometric view of the dispensing cap of FIG. 1 in cross-section.
Figure 3:
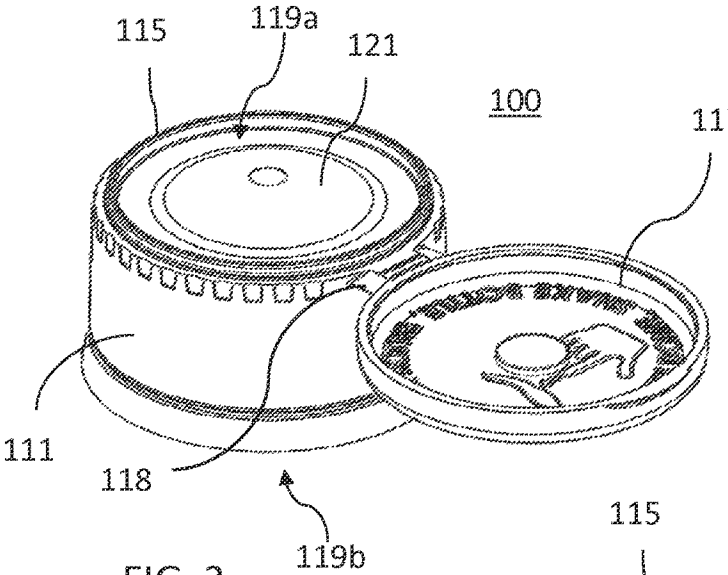
FIG. 3 is an isometric view of another dispensing cap according to another embodiment.

This disclosure describes a new design for a single chamber dispensing cap for a container that is configured for holding an additive substance that can dispense the additive substance into the container when desired. FIGS. 1 and 2 show one embodiment of such a dispensing cap 10. The dispensing cap 10 has a generally cylindrical body 11 that forms an outer wall of the cap structure, a closed top end 19*a* and an open bottom end. The dispensing cap 10 is configured to engage and fit over an opening of a container such as a beverage bottle. The body 11 can be configured and adapted to engage the opening of a container by snap fitting manner or be threaded on. As shown in FIG. 2, the body 11 and an inner wall 13 form a container receptacle 12 that is open on the bottom side of the dispensing cap 10. The container receptacle 12 allows the cap 10 to receive a mouth of a container (not shown). The container receptacle 12 is configured with a screw threading 30 along the inside surface of the body 11. The screw threading 30 cooperates with the corresponding screw threading on the mouth of the container for securing the dispensing cap 10 thereon and seal the contents of the container, which is generally a liquid.

The inner wall 13 axially extends from the closed top end of the dispensing cap 10 toward the open bottom end of the dispensing cap and define a chamber 50 for holding an additive substance. The dispensing cap 10 is generally used as a closure for a container, such as a bottle, that holds a liquid beverage (e.g. water, juice, etc.).

The chamber 50 is sealed by a chamber closure member 60. The chamber closure member 60 forms a liquid-tight seal so that the substance held inside the chamber 50 is kept separate from the liquid beverage in the container. This allows the dispensing cap 10 to be pre-filled with a desired substance and installed onto the container without coming in contact with or being concerned with the substance held inside the dispensing cap 10.

The chamber closure member 60 is connected to a plunger 22. The plunger 22 is configured to be in one of two positions, an open position (FIG. 1) and an unsealed position (FIG. 2). When the dispensing cap 10 is threaded onto the mouth of a container (not shown), pressing down on the plunger 22 from the top of the dispensing cap 10 forces the plunger 22 to push the chamber closure member 60 downward further into the container and unseal the chamber 50. This allows the contents of the chamber 50 to fall into the container and mix with the liquid content of the bottle.

The plunger 22 is pushed into its open position by a person pushing the flexible diaphragm 21 of the dispensing cap downward. The flexible diaphragm 21 is preferably configured to snap into the open position when pressed down and thus maintain the open position even when the person stops pushing down on the diaphragm 21.

According to an embodiment, the body 11, the closed top end 19*a*, the plunger 22, and the inner wall 13 are integrally formed in a one-piece construction.

In another embodiment, the dispensing cap 10 is configured with a flip-top lid 17. The flip-top lid 17 can prevent accidental activation of the plunger 22. This allows the contents of the dispensing cap 10 to be released at the time of ingestion of the contents of the container. The flip-top lid 17 also can be integrally formed with the body 11, the closed top end 19*a* and the inner wall 13.

Referring to FIG. 3-13, a dispensing cap 100 for a container according to an embodiment of the present disclosure will be described. The dispensing cap 100 comprises a generally cylindrically-shaped body portion 111 having a closed top end 119*a* and an open bottom end 119*b*. The closed top end 119*a* is integrally formed with the body portion 111 and includes a diaphragm portion 121 that can be pressed downward (i.e. the direction towards the open bottom end 119*b* as shown) to activate the dispensing cap 100 and dispense the contents of the cap. The dispensing cap 100 is preferably molded from a suitable plastic or polymer material and the body portion 111, the closed top end 119*a*, the plunger 122, and the inner wall 113 are integrally formed by being molded in one-piece construction. This allows for simpler product design and more cost efficient manufacturing. The integrally formed construction also enables lower cost assembly of the dispensing cap because only two pieces, the chamber closure member 160 and the rest of the structure, need to be assembled.

Figure 4:
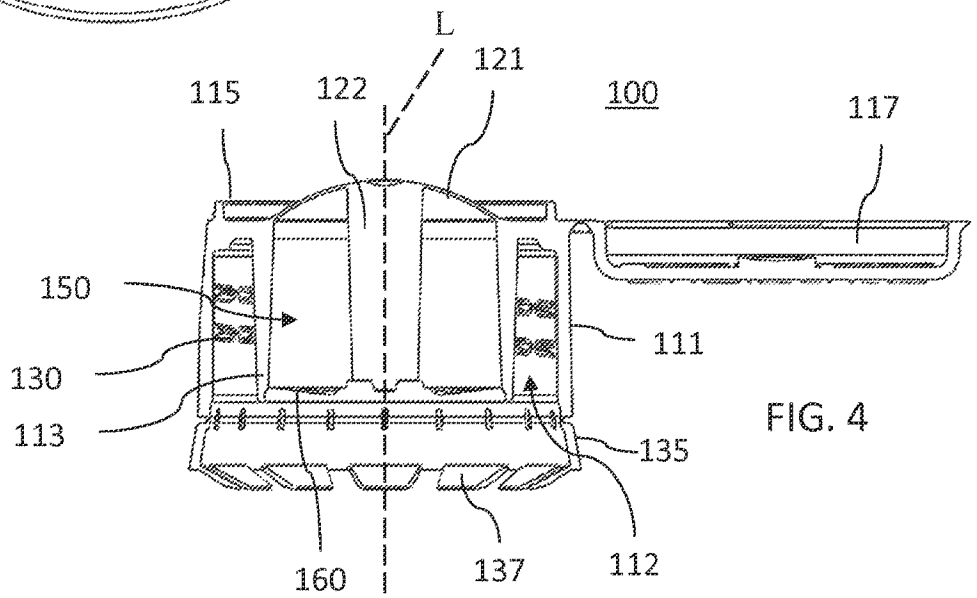
FIG. 4 is an cross-sectional view of the dispensing cap of FIG. 3.

As shown in FIG. 4, a generally cylindrically-shaped inner wall 113 axially extends from the closed top end 119*a* of the body portion 111 towards the open bottom end 119*b* of the body portion and defines a chamber 150 for holding an additive substance. As used herein, axially extending means extending in a direction parallel to the longitudinal axis L of the dispensing cap 100.

Because of the integrally molded structure of the body portion 111, the closed top end 119*a*, and the inner wall 113, the diaphragm portion 121 forms the top of the chamber 150 that is closed and the chamber 150 has a sealable opening towards the open bottom end of the body portion 111.

Figure 7:
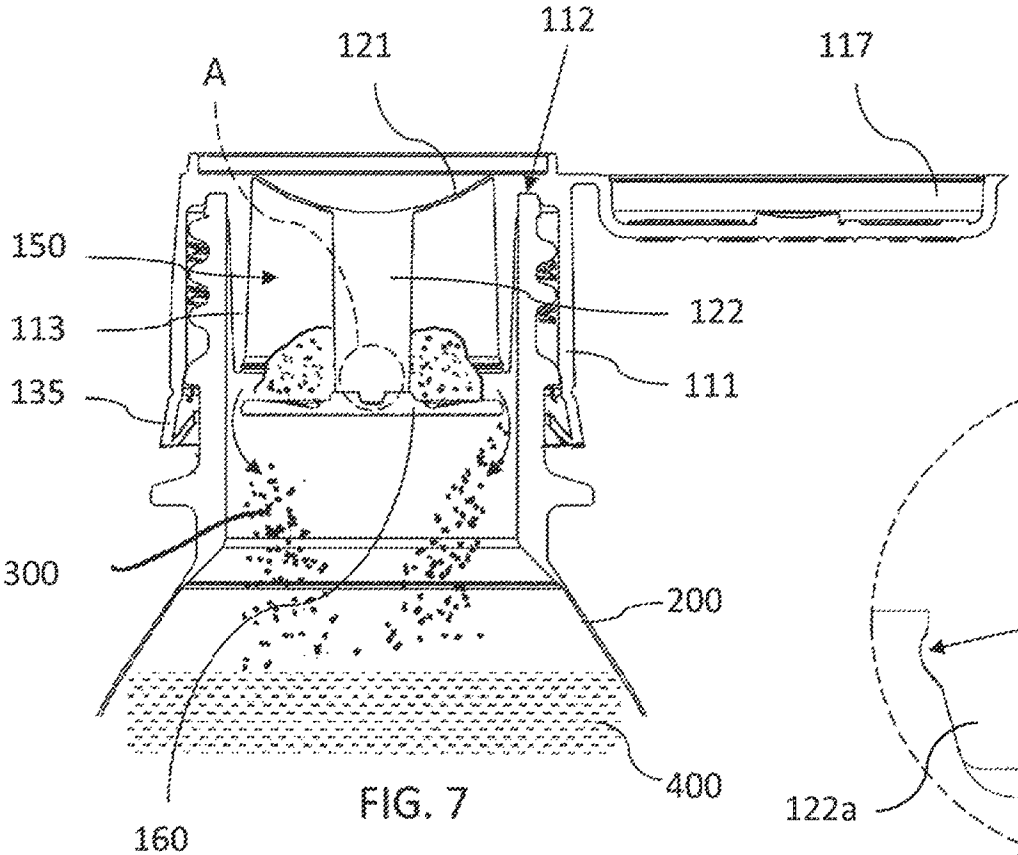
FIG. 7 is a cross-sectional view of the dispensing cap and the container of FIG. 6 in which the chamber of the dispensing cap is unsealed and the additive substance from the chamber is being dispensed.
Figure 8:
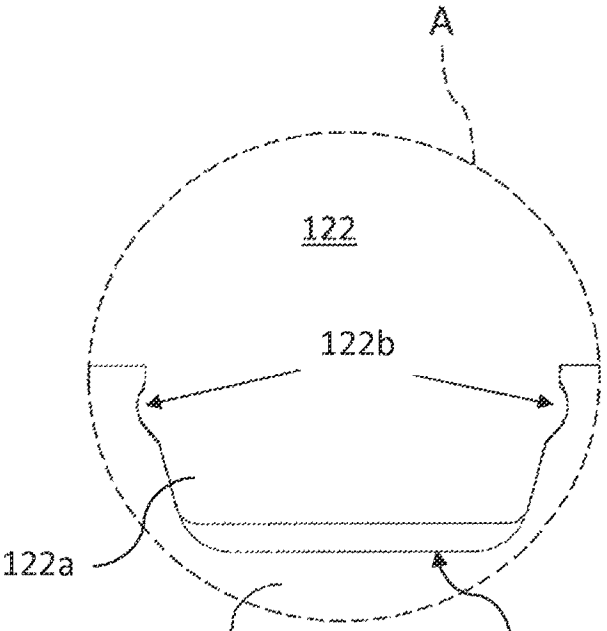
FIG. 8 is a detailed cross-sectional view of the area A shown in FIG. 7.

The body portion 111 and the inner wall 113 defining a receptacle 112 therebetween for receiving a mouth of the container from the open bottom end 119*b* of the body portion and sealing the mouth of the container. Inside the chamber 150 is provided a plunger 122 axially extending from the diaphragm portion 121 towards the opening of the chamber 150, wherein the diaphragm 121 and the plunger 122 have a closed position and an open position. FIG. 4 shows the diaphragm 121 and the plunger 122 in the closed position. FIG. 7, discussed below, shows the diaphragm 121 and the plunger 122 in the open position.

In the closed position shown in FIG. 4, a chamber closure member 160 for sealing the chamber's opening is attached to the plunger 122. The chamber closure member 160 is configured for cooperating with the inner wall 113 and seal the chamber 150 when the diaphragm 121 and the plunger 122 are in the closed position.

Referring to FIGS. 9-13, the chamber closure member 160 is a disc-like structure having a sealing surface 167 along its periphery for cooperating with the inner wall 113 for sealing the chamber 150. The inner wall 113 has a corresponding sealing surface that cooperates with the sealing surface 167 of the chamber closure member 160 for sealing the chamber 150.

The sealing surface 167 of the chamber closure member 160 comprises an inner sealing surface 167*a* and an outer sealing surface 167*b*. The inner sealing surface 167*a* is configured to cooperate with corresponding inner sealing surface 113*a* on the inner wall 113 and the outer sealing surface 167*b* is configured to cooperate with the corresponding outer sealing surface 113*b* on the inner wall 113. These sealing surfaces are referred to as "inner" or "outer" for their respective proximity to the interior of the chamber 150. The sealing surfaces 167*a* and 113*a* are closer to the interior of the chamber 150 than the sealing surfaces 167*b* and 113*b*.

The inner sealing surfaces 167*a* and 113*a* form a seal against conditions where the external ambient pressure is higher than the internal ambient pressure inside the chamber 150. The outer sealing surfaces 167*b* and 113*b* form a seal against conditions where the internal ambient pressure in the chamber 150 is higher than the external ambient pressure. This is achieved by the particular geometry and configuration of the sealing surfaces 167*a*, 167*b*, 113*a* and 113*b* further explained below.

Figure 13:
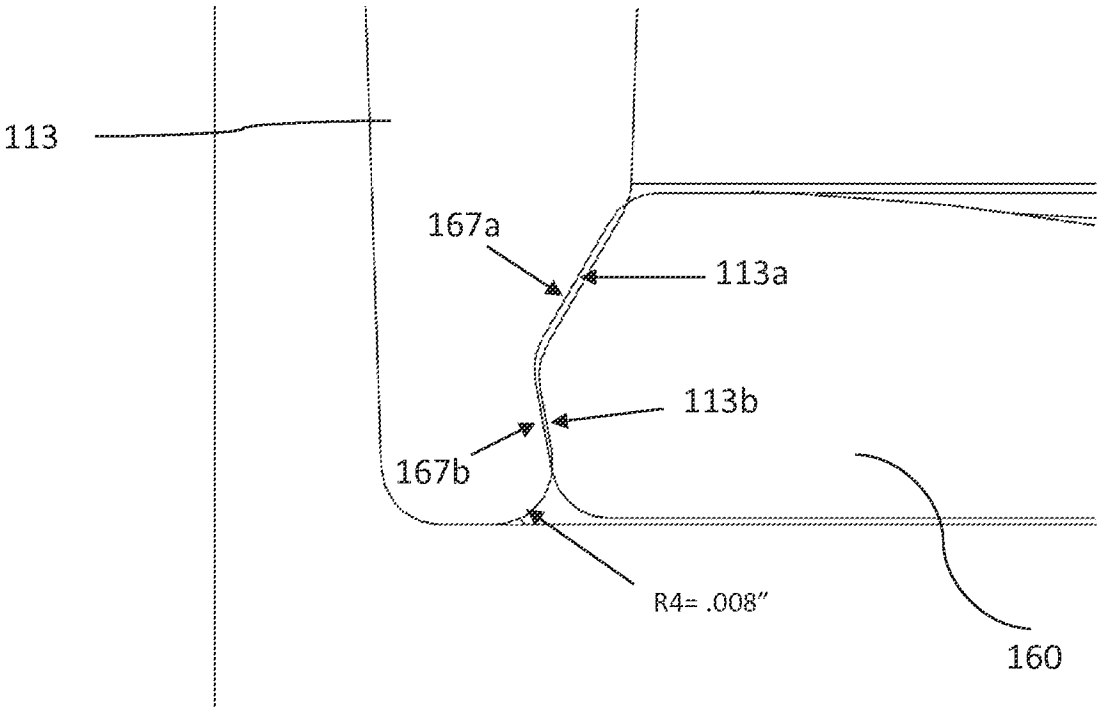
FIG. 13 is a detailed view of the sealing surfaces of the chamber closure member of FIG. 9 cooperating with the inner wall of the dispensing cap and sealing the chamber.
Figure 14:
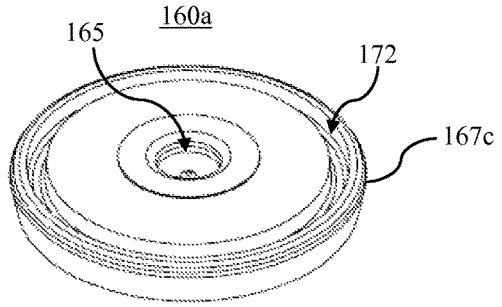
FIG. 14 is an isometric view of a chamber closure member according to another embodiment showing the top side of the chamber closure member.

These cooperating sealing surfaces on the chamber closure member 160 and the inner wall 113 are configured to form a seal against each other by interference fitting. This means that the diameter of the chamber closure member 160 along its sealing surface 167 is larger than the inside diameter of the opening formed by the sealing surfaces on the inner wall 113 by a predetermined amount. Thus, when the chamber closure member 160 is inserted into the chamber opening formed by the inner wall 113, the sealing surface 167 of the chamber closure member 160 presses outwardly against the corresponding sealing surface on the inner wall 113 and creates an interference fit. FIG. 13 illustrates this by showing the sealing surfaces 167*a*, 167*b* of the chamber closure member 160 overlapping with the corresponding sealing surfaces 113*a*, 113*b* of the inner wall 113. In one embodiment, the chamber closure member 160 and the inner wall 113 form a liquid tight seal.

Figure 12:
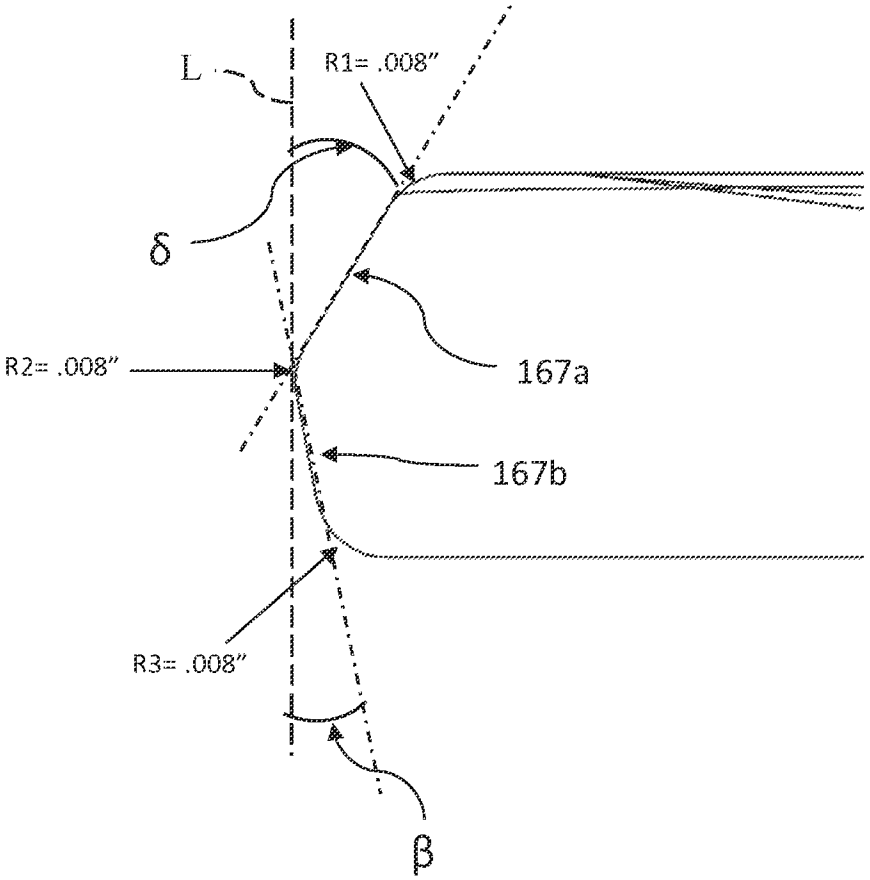
FIG. 12 is a detailed view of the sealing surfaces of the chamber closure member of FIGS. 9 and 10 according to an embodiment.

As shown in FIG. 12, according to one embodiment, the mating inner sealing surfaces 167*a* and 113*a* are sloped at about 30-32° relative to the longitudinal axis L of the body portion 111. This slope angle is labeled as δ in FIG. 12. The mating outer sealing surfaces 167*b* and 113*b* are sloped at about 10-12° relative to the longitudinal axis L. This slope angle is labeled as β in FIG. 12. In a preferred embodiment, the slope angle δ is 31° and the slope angle β is 11° relative to the longitudinal axis L.

Referring to FIGS. 7-11, the chamber closure member 160 has a top side that faces the closed top side of the body portion and a bottom side that faces away from the chamber. The plunger is attached to the chamber closure member 160 near the center of the chamber closure member 160. In an embodiment, the plunger and the chamber closure member are configured to be press-fitted to each other as shown in detail in FIGS. 7 and 8. As an example, the chamber closure member 160 is provided with a plunger receiving cavity 165 as identified in FIGS. 9 and 11 and the plunger is 122 is provided with a protruding member 122*a* having an annular rib 122*b* for press-fitting into the cavity 165. The area A identified in FIG. 7 where the plunger 122 and the chamber closure member 160 are attached is shown in a close up detailed view in FIG. 8.

According to an embodiment, the chamber closure member 160 is provided with stress-relieving depressions 162, 163 on the top side. When an activating force is applied to the diaphragm and as the plunger 122 pushes down on the chamber closure member 160 while moving from the closed position to the open position, the stress-relieving depressions 162, 163 enable the chamber closure member to elastically collapse and facilitate unsealing of the chamber closure member 160 from the inner wall 113. Elastically collapsing refers to the chamber closure member 160 folding like an umbrella, albeit slightly, to facilitate unsealing of the chamber closure member 160 from the inner wall 113. The slope of the outer sealing surfaces 167*b* and 113*b* enables unsealing of the chamber closure member 160 as the chamber closure member is pushed out of the closed position by the plunger 122, the elastic collapsing of the chamber closure member further facilitates the unsealing action.

Figure 10:
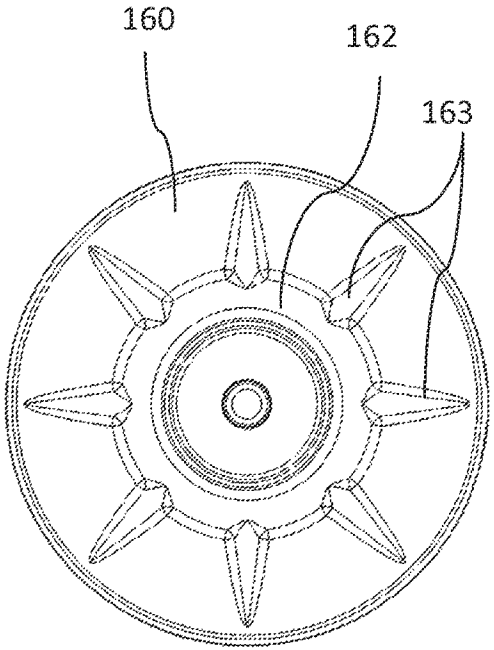
FIG. 10 is a top view of the chamber closure member of FIG. 9.
Figure 9:
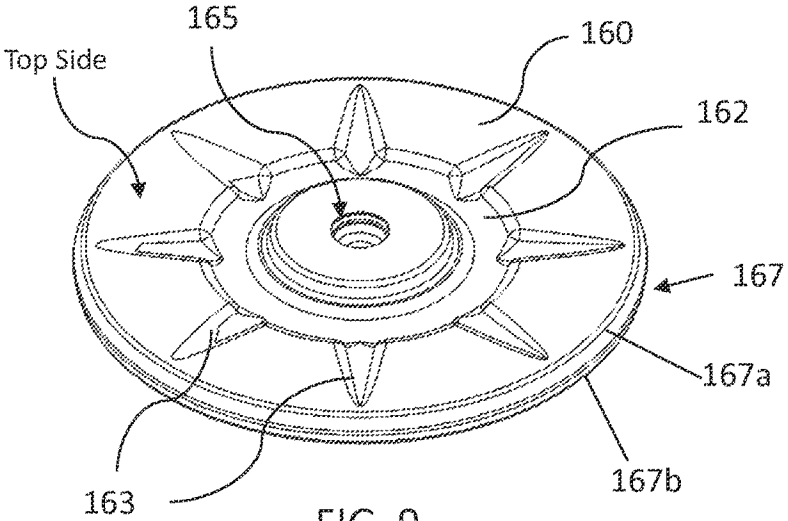
FIG. 9 is an isometric view of a chamber closure member according to an embodiment.
Figure 11:
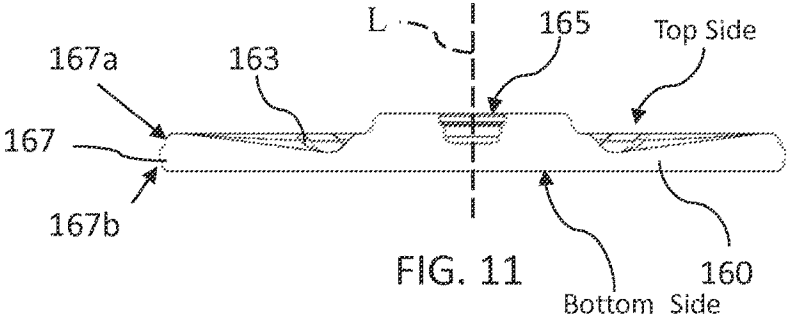
FIG. 11 is a cross-sectional view of the chamber closure member of FIGS. 9 and 10.

As shown in FIGS. 9 and 10, the stress-relieving depressions 162, 163 can comprise an annular depression 162 and a plurality of radially oriented depressions 163. In one embodiment, the radially oriented depressions 163 are arranged at about 45° from one another and pointing radially outward from the center of the chamber closure member 160 in order to optimize the collapsing effect of the chamber closure member.

Figure 5:
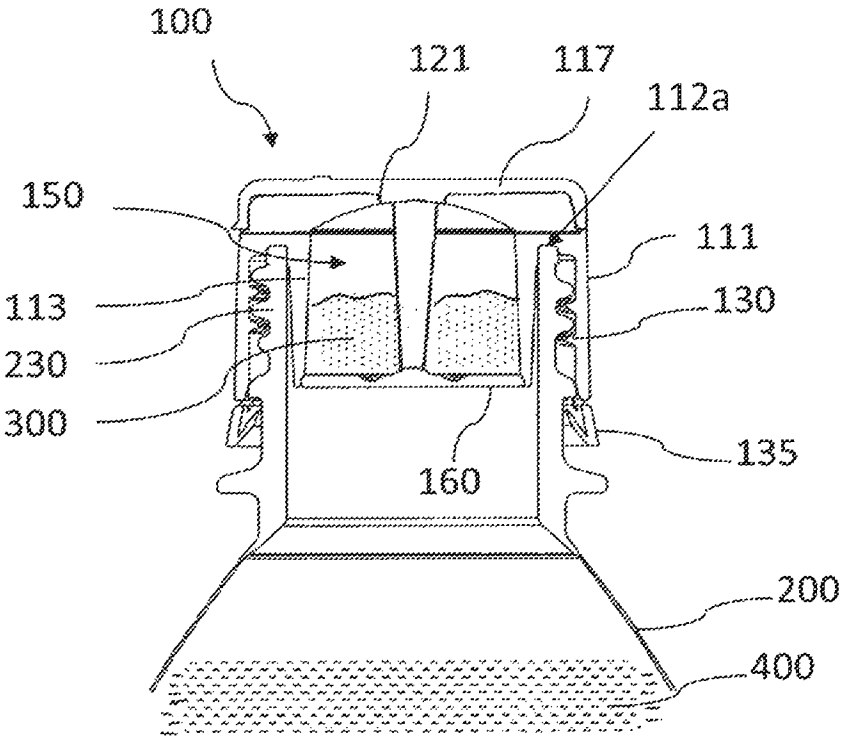
FIG. 5 is a cross-sectional view of the dispensing cap of FIG. 3 holding a quantity of an additive substance in its chamber and connected to a container.

Referring back to FIG. 4, dispensing cap 100 has a receptacle 112 defined between the body portion 111 and the inner wall 113 for receiving a mouth of a container. As shown in the example of FIG. 5, the receptacle 112 can include a screw threading 130 for threadably engaging the corresponding screw threading 230 on the mouth of a container 200 and connecting the dispensing cap 100 to the mouth of a container 200. The mouth of the container 200 thus forms a seal at the far end 112*a* of the receptacle 112 thereby sealing the contents 400 of the container 200 therein when the dispensing cap is mounted for use on the container 200. In FIG. 5, the dispensing cap 100 is fully assembled and the chamber 150 is holding an additive substance 300. The additive substance can be in a liquid form or a powder form.

FIG. 7 shows the dispensing cap 100 in an open configuration where the additive substance 300 is being dispensed into the container 200 and mixing with the content 400 of the container 200. The content 400 can be a liquid beverage or a medicament. As shown, the diaphragm 121 and the plunger 122 are pushed downward and in their open position. The plunger 122 has pushed the chamber closure member 160 downward unsealing the chamber closure member 160 from the sealing surfaces of the inner wall 113.

Figure 6:
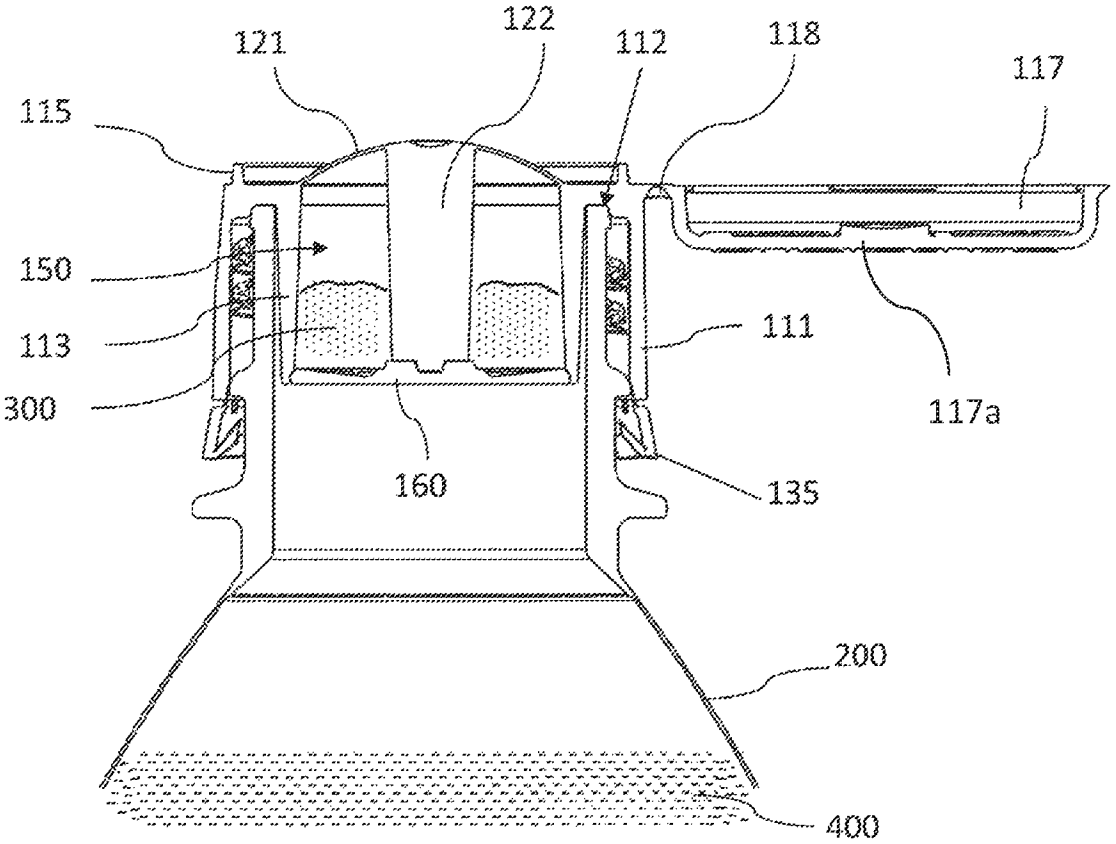
FIG. 6 is another cross-sectional view of the dispensing cap and the container of FIG. 5 in which the flip-top lid of the dispensing cap is in open position.

As shown in FIGS. 4-7, according to another embodiment, the dispensing cap 100 can further comprise a tamper ring 135 for preventing unintentional unthreading of the dispensing cap 100 from the mouth of the container 200. The tamper ring 135 has a structure similar to many tamper rings found on various beverage holding containers. The tamper ring 135, if one is provided, is removably attached to the bottom end of the body portion 111 and has a plurality of flaps 137. When the dispensing cap 100 is mounted onto the mouth of the container 200, the flaps 137 get folded inward and up as shown in FIGS. 5 and 6 and the flaps 137 interfere with annular protrusions on the mouth of the container 200 and prevents unintentional unthreading of the dispensing cap 100. In order to remove the dispensing cap 100 from the container 200, after the dispensing cap 100 is activated and the content of the chamber 150 is dispensed into the container 200, the user can forcibly unscrew the dispensing cap 100 from the container which tears the breakable joint between the tamper ring 135 and the body portion 111.

In another embodiment, the receptacle 112 is configured for snap-fitting onto the mouth of a container 200, thereby sealing contents of the container therein when the dispensing cap is mounted for use on the container.

In another embodiment, the dispensing cap 100 can further comprise a flip-top lid 117 that is attached to the body portion 111 by a hinge 118. A locking ridge 115 is provided on the body portion 111 for locking the flip-top lid 117 closed over the diaphragm 121 and prevent accidental actuation of the diaphragm 121.

The chamber closure member 160 and the plunger 122 are configured to be press-fitted to each other and the flip-top lid 170 is provided with a diaphragm supporting pedestal 117*a* for supporting the diaphragm 121 during assembly of the dispensing cap when the chamber closure member is being pressed on to the plunger and seal the chamber.

Figure 15:
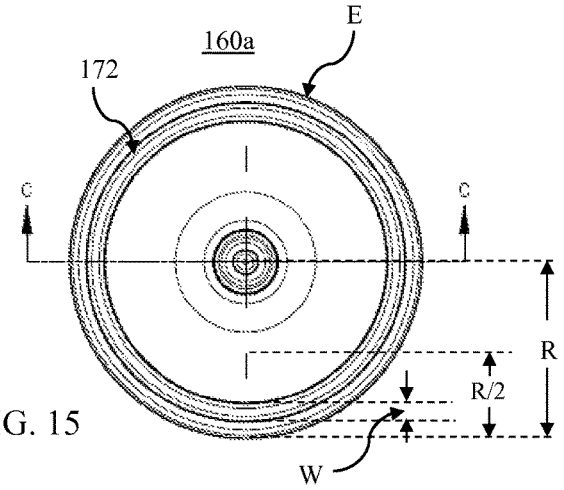
FIG. 15 is a plan view of the top side of the chamber closure member of FIG. 14.

Referring to FIGS. 14-17, a chamber closure member 160*a* according to another embodiment is disclosed. As with the chamber closure member 160, the chamber closure member 160*a* is configured to couple to a plunger, such as the plunger 122. Provided on the top side of the chamber closure member 160*a* is a stress-relieving depression 172. The stress-relieving depression 172 is an annular depression extending circumferentially about the outer periphery of the chamber closure member 160*a*. The chamber closure member 160 has a radius R and the annular depression 172 has a width W that is about 1/11 to 2/11 of the radius R. The width W of the annular depression 172 is not too wide so that the bulk of the chamber closure member 160*a* does not get too thin. The annular depression 172 is provided to be closer to the periphery of the chamber closure member 160*a*. For example, as shown in FIG. 15, the annular depression 172 is positioned to be within a region that is R/2 from the outer edge E of the chamber closure member. Having the annular depression 172 close to the periphery allows the periphery portion 167*c* of the chamber closure member 160*a* to flex or collapse inward and help to unseal the chamber closure member 160*a* from the sealing surfaces of the inner wall 113 when the plunger 122 pushes the chamber closure member downward.

When an activating force is applied to the diaphragm and as the plunger 122 pushes down on the chamber closure member 160*a* while moving from the closed position to the open position, the stress-relieving depression 172 on the top side of the chamber closure member 160*b* enable the chamber closure member to elastically collapse and facilitate unsealing of the chamber closure member 160*b* from the inner wall 113. Elastically collapsing refers to the chamber closure member 160*b* folding like an umbrella, albeit slightly, to facilitate unsealing of the chamber closure member 160*b* from the inner wall 113.

Figure 16:
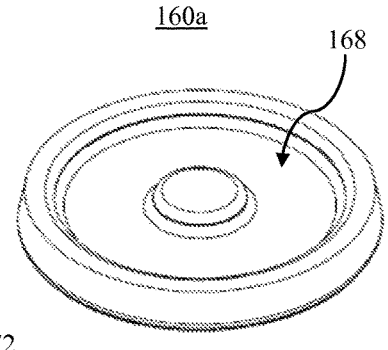
FIG. 16 is an isometric view of the chamber closure member of FIG. 14 showing the bottom side of the chamber closure member.
Figure 17:
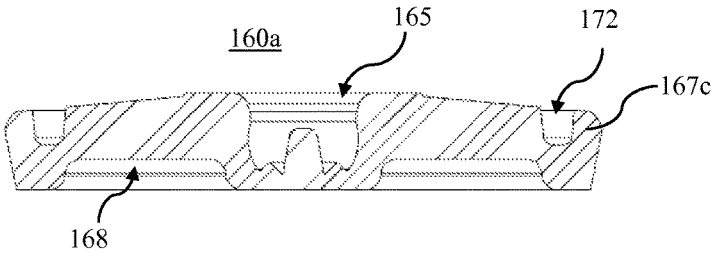
FIG. 17 is a cross-sectional view of the chamber closure member of FIGS. 14, 15, and 16 where the section is taken through the line C-C shown in FIG. 15.
Figure 18:
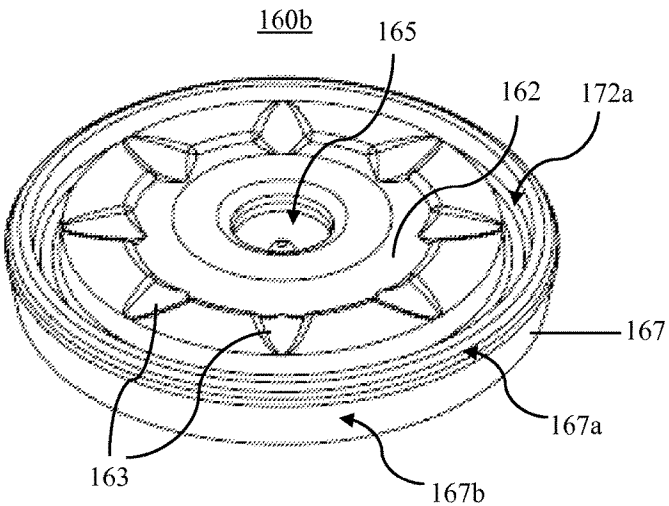
FIG. 18 is an isometric view of a chamber closure member according to another embodiment showing the top side of the chamber closure member.
Figure 19:
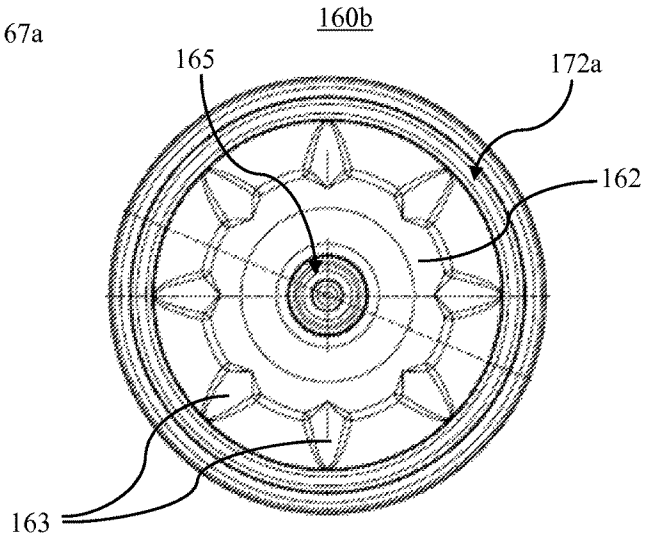
FIG. 19 is a plan view of the top side of the chamber closure member of FIG. 18.

Referring to FIGS. 16 and 17, the chamber closure member 160*a* may be provided with a bottom side depression 168. The depth of the bottom side depression 168 can be adjusted to obtain the desired thickness for the chamber closure member 160*a*.

Referring to FIGS. 18-21, a chamber closure member 160*b* according to another embodiment is disclosed. The chamber closure member 160*b* is also configured to couple to the plunger 122. The chamber closure member 160*b* is provided with one or more stress-relieving depressions on its top side. Similar to the chamber closure member 160, provided on the top side of the chamber closure member 160*b* are the first stress-relieving annular depression 162 extending circumferentially about an inner circumference of the chamber closure member 160*b* and the radially extending stress-relieving depressions 163. Furthermore, similar to the chamber closure member 160*a*, the chamber closure member 160*b* is further provided with a second stress-relieving annular depression 172*a* on the top side extending circumferentially about the outer periphery of the chamber closure member 160*b*, similar to the annular depression 172 of the chamber closure member 160*a*. The second annular depression 172*a* is provided between the radially extending stress-relieving depressions 163 and the periphery of the chamber closure member 160*b*.

Figure 20:
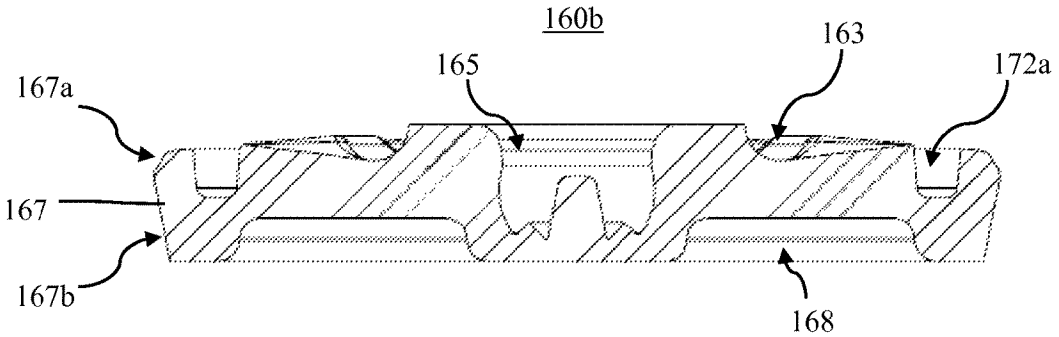
FIG. 20 is a cross-sectional view of the chamber closure member of FIG. 18.
Figure 21:
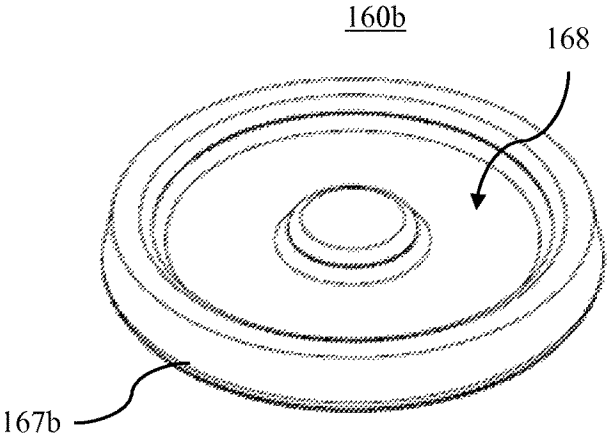
FIG. 21 is an isometric view of the chamber closure member of FIG. 18 showing the bottom side of the chamber closure member.

As shown in FIGS. 20 and 21, similar to the chamber closure member 160*a*, the chamber closure member 160*b* can also be provided with the bottom-side depression 168 on its bottom side.

In some embodiments, the radially oriented depressions 163 extend from the first annular depression 162 to the second annular depression 172*a*. The radially oriented depressions 163 can extend at least partially into the second annular depression 172*a*. The radially oriented depressions 163 can provide a continuous flexible area extending between the first annular depression 162 and the second annular depression 172*a* in order to optimize the collapsing effect of the chamber closure member 160*b*.

When an activating force is applied to the diaphragm and as the plunger 122 pushes down on the chamber closure member 160*b* while moving from the closed position to the open position, the stress-relieving depressions 162, 163, and 172*a* on the top side of the chamber closure member 160*b* enable the chamber closure member to elastically collapse and facilitate unsealing of the chamber closure member

160*b* from the inner wall 113. Elastically collapsing refers to the chamber closure member 160*b* folding like an umbrella, albeit slightly, to facilitate unsealing of the chamber closure member 160*b* from the inner wall 113. The slope of the outer sealing surfaces 167*b* and 113*b* also enables unsealing of the chamber closure member 160*b* along with the elastic collapsing of the chamber closure member, as the chamber closure member is pushed out of the closed position by the plunger 122.

Existing bottle designs can be used with no modifications bottle can be easily recycled it will have no contaminants molded into it environmentally friendly. The container lids disclosed herein can be manufactured from several materials including but not limited to polymers, composites and flexible metal alloys.

According to another embodiment, a dispensing cap for use with a container where the dispensing cap is filled with a quantity of an additive substance is described. The dispensing cap comprises a generally cylindrically-shaped body portion having a closed top end and an open bottom end. The closed top end is integrally formed with the body portion and comprises a diaphragm portion. A generally cylindrically-shaped inner wall axially extends from the closed top end towards the open bottom end of the body portion and defines a chamber. The chamber has an opening towards the open bottom end of the body portion that is removably sealed by a chamber closure member. A quantity of an additive substance is provided in the chamber. The body portion and the inner wall define a receptacle therebetween for receiving a mouth of the container from the open bottom end of the body portion and sealing the mouth of the container. A plunger axially extending from the diaphragm portion towards the opening of the chamber is provided in the chamber. The diaphragm and the plunger have a closed position and an open position, and whilst holding the additive substance in the chamber, the diaphragm and the plunger are in the closed position until a user activates the diaphragm and the plunger to dispense the additive substance.

The structure of the dispensing cap of the present disclosure is scalable for several different sizes of liquid containers. The volume of the single chamber design allows for dispensing additive substances, such as, flavorings, vitamins, energy boosting formulation, medication, purification and tranquil drinks or any combination of these ingredients.

It is to be realized that the optimum dimensional relationships for the parts of the dispensing cap described herein, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the invention has been described using a few example embodiments, the scope of the invention described herein is to be defined and limited only by the appended claims and include other variants and embodiments of the invention, which may be made by those skilled in the art without departing from the scope and range of equivalents of the invention.

What is claimed is:

1. A dispensing cap for a container, the dispensing cap comprising:

a generally cylindrically-shaped body portion having a closed top end and an open bottom end, the closed top end comprising a diaphragm portion;

a generally cylindrically-shaped inner wall axially extending from the closed top end towards the open bottom end of the generally cylindrically-shaped body portion and defining a chamber for holding an additive substance, wherein the chamber has an opening towards the open bottom end of the generally cylindrically-shaped body portion;

the generally cylindrically-shaped body portion and the generally cylindrically-shaped inner wall defining a receptacle therebetween for receiving a mouth of the container from the open bottom end of the generally cylindrically-shaped body portion and sealing the mouth of the container;

a plunger axially extending from the diaphragm portion towards the opening of the chamber, wherein the diaphragm and the plunger have a closed position and an open position; and a chamber closure member for sealing the chamber's opening attached to the plunger, wherein the chamber closure member is a disc-like structure having a sealing surface along its periphery and the generally cylindrically-shaped inner wall has a corresponding sealing surface that cooperates with the sealing surface of the chamber closure member for sealing the chamber when the diaphragm and the plunger are in the closed position, wherein the chamber closure member has a top side that faces the closed top end of the generally cylindrically-shaped body portion and a bottom side that faces away from the chamber, and further wherein the chamber closure member is provided with one or more stress-relieving depressions on the top side, thereby when an activating force is applied to the diaphragm and the plunger is being moved from the closed position to the open position, the one or more stress-relieving depressions enable the chamber closure member to elastically collapse and facilitate unsealing of the chamber closure member from the generally cylindrically-shaped inner wall, and wherein the chamber closure member is provided with a bottom side depression for controlling the thickness of the chamber closing member, wherein the one or more stress-relieving depressions comprise a first annular depression extending circumferentially along a periphery of the chamber closure member, wherein the generally cylindrically-shaped body portion, the closed top end, the plunger, and the generally cylindrically-shaped inner wall are integrally formed.

2. The dispensing cap according to claim 1, the one or more stress-relieving depressions further comprising:

a second annular depression extending circumferentially about the chamber closure member, wherein the second annular depression has a smaller diameter than the first annular depression; and a plurality of radially oriented depressions extending between the first annular depression and the second annular depression.

3. The dispensing cap according to claim 1, wherein the sealing surface of the chamber closure member comprising an inner sealing surface and an outer sealing surface, wherein the inner sealing surface is configured to cooperate with the corresponding surface on the generally cylindrically-shaped inner wall to seal against higher external ambient pressure condition and the outer sealing surface is configured to cooperate with the corresponding surface on the generally cylindrically-shaped inner wall to seal against higher internal ambient pressure condition.

4. The dispensing cap according to claim 3, wherein the inner sealing surface is sloped at about 30°-32° relative to the longitudinal axis of the generally cylindrically-shaped body portion.

5. The dispensing cap according to claim 3, wherein the outer sealing surface is sloped at about 10°-12° relative to the longitudinal axis of the generally cylindrically-shaped body portion.

6. The dispensing cap according to claim 1, wherein the chamber closure member and the generally cylindrically-shaped inner wall form a liquid tight seal.

7. The dispensing cap according to claim 1, wherein the receptacle includes a screw threading for threadably connecting the dispensing cap to the mouth of the container, thereby sealing contents of the container therein when the dispensing cap is mounted for use on the container.

8. The dispensing cap according to claim 7, further comprising a tamper ring for preventing unintentional unthreading of the dispensing cap from the mouth of the container.

9. The dispensing cap according to claim 1, wherein the receptacle is configured for snap-fitting onto the mouth of a container, thereby sealing contents of the container therein when the dispensing cap is mounted for use on the container.

10. The dispensing cap according to claim 1, further comprising a flip-top lid that is attached to the generally cylindrically-shaped body portion by a hinge and a locking ridge provided on the body portion for locking the flip-top lid closed over the diaphragm and prevent accidental actuation of the diaphragm.

11. The dispensing cap according to claim 10, wherein the chamber closure member and the plunger are configured to be press-fitted to each other and the flip-top lid is provided with a diaphragm supporting pedestal for supporting the diaphragm during assembly of the dispensing cap when the chamber closure member is being pressed on to the plunger and seal the chamber.

12. A dispensing cap for a container, the dispensing cap comprising:

a generally cylindrically-shaped body portion having a closed top end and an open bottom end, the closed top end comprising a diaphragm portion;

a generally cylindrically-shaped inner wall axially extending from the closed top end towards the open bottom end of the generally cylindrically-shaped body portion and defining a chamber for holding an additive substance, wherein the chamber has an opening towards the open bottom end of the generally cylindrically-shaped body portion;

the generally cylindrically-shaped body portion and the generally cylindrically-shaped inner wall defining a receptacle therebetween for receiving a mouth of the container from the open bottom end of the generally cylindrically-shaped body portion and sealing the mouth of the container;

a plunger axially extending from the diaphragm portion towards the opening of the chamber, wherein the diaphragm and the plunger have a closed position and an open position; and a chamber closure member for sealing the chamber's opening attached to the plunger, wherein the chamber closure member is a disc-like structure having a sealing surface along its periphery and the generally cylindrically-shaped inner wall has a corresponding sealing surface that cooperates with the sealing surface of the chamber closure member for sealing the chamber when the diaphragm and the plunger are in the closed position, wherein the chamber closure member has a top side that faces the closed top end of the generally cylindrically-shaped body portion and a bottom side that faces away from the chamber, and further wherein the chamber closure member is provided with a stress-relieving depression on the top side, thereby when an activating force is applied to the diaphragm and the plunger is being moved from the closed position to the open position, the stress-relieving depression enables the chamber closure member to elastically collapse and facilitate unsealing of the chamber closure member from the generally cylindrically-shaped inner wall, wherein the stress-relieving depression is an annular depression extending circumferentially along a periphery of the chamber closure member.

13. The dispensing cap according to claim 12, wherein the chamber closure member is provided with a bottom side depression for controlling the thickness of the chamber closure member.

14. The dispensing cap according to claim 12, wherein the receptacle includes a screw threading for threadably connecting the dispensing cap to the mouth of the container, thereby sealing contents of the container therein when the dispensing cap is mounted for use on the container.

15. The dispensing cap according to claim 12, further comprising a flip-top lid that is attached to the generally cylindrically-shaped body portion by a hinge and a locking ridge provided on the generally cylindrically-shaped body portion for locking the flip-top lid closed over the diaphragm and prevent accidental actuation of the diaphragm.

16. The dispensing cap according to claim 15, wherein the chamber closure member and the plunger are configured to be press-fitted to each other and the flip-top lid is provided with a diaphragm supporting pedestal for supporting the diaphragm during assembly of the dispensing cap when the chamber closure member is being pressed on to the plunger and seal the chamber.

* * * * *